US006053442A

United States Patent [19]

Matsuo

[11] Patent Number: 6,053,442

[45] Date of Patent: Apr. 25, 2000

[54] HIGH-SPEED CRUSHING APPARATUS

[75] Inventor: Mu Matsuo, Shizuoka-ken, Japan

[73] Assignee: Matsumoto Sangyo Kabushiki Kaisha, Fuji, Japan

[21] Appl. No.: 09/028,998

[22] Filed: Feb. 25, 1998

[51] Int. Cl.[7] ..... B02C 13/02

[52] U.S. Cl. ..... 241/154; 241/185.5; 241/189.1; 241/242

[58] Field of Search ..... 241/101.76, 154, 241/242, 292.1, 185.5, 189.1

[56] References Cited

U.S. PATENT DOCUMENTS

| | | | |
|---|---|---|---|
| 2,981,485 | 4/1961 | Mainone | 241/101.76 |
| 4,702,424 | 10/1987 | Widlak | 241/101.76 |
| 5,390,862 | 2/1995 | Eglin | 241/29 |

FOREIGN PATENT DOCUMENTS 9-38516 2/1997 Japan .

*Primary Examiner*—John M. Husar
*Attorney, Agent, or Firm*—Oliff & Berridge, PLC

[57] ABSTRACT

A high-speed crushing apparatus comprising two cutting edges one of which is stationary-type and the other rotary-type, a crusher disposed downstream of the edges including a shaft facing the rotary-type cutting edge and a plurality of cutters attached rotatably in the rotation axis direction and slidably to the shaft, and a guide plate disposed therebetween. The guide plate delivers fragments before the cutters and they are cut at a cutting angle determined by the position of the end surface of the guide plates. The apparatus is used suitably for disposal of scrap woods of various sizes and hardness.

5 Claims, 4 Drawing Sheets

HIGH-SPEED CRUSHING APPARATUS

BACKGROUND OF THE INVENTION

1. Field of the Invention

The invention relates to a high-speed crushing apparatus for finely crushing scrap woods such as branches, leaves, trunks and roots which are produced when trees are trimmed in park, green zone, median strip and the like.

2. Description of the Prior Art

As a crushing apparatus for disposal of scrap woods such as ones from tree, there have heretofore been provided a crushing apparatus which comprises, below a hopper, a hummer part for crushing scrap wood into fragments, a smashing part for further size-reducing the fragments, and a mesh-screening part for adjusting the size of the size-reduced fragments. The apparatus, however, has problems. Firstly, the apparatus cannot work successfully when as the scrap woods are disposed trunks and big branches because they have growth rings. When they are incharged into the apparatus, they are not crushed but are elastically deformed such as a rubber ball, thus bounding and making a noise. Further, when as the scrap woods are disposed flexible small branches, leaves and roots with the apparatus, they can not be crushed successfully. These flexible scrap woods are recognized to be crushed if the crushing apparatus is provided with a thin cutting edge. Such an apparatus, however, involves several disadvantages. Firstly, mounting operation of the thin cutting edge is very difficult from a technical viewpoint. Secondly, its mounting and removing operation involves a risk. Therefore, the apparatus of that kind has not been used.

Referring again to the crushing apparatus (comprising a hummer part for crushing scrap wood into fragments, a smashing part for further size-reducing the fragments, and a mesh-screening part for adjusting the size of the size-reduced fragments), the mesh-screening part tends to get plugged, which results in no practical use. Further, scrap woods usually involve branch, leaf and root having sand and soil attached thereto. In addition, scrap woods may contain gravel admixed thereto. When such scrap woods are disposed with the apparatus, the rotary-type cutting edge and the stationary-type cutting edge thereof are damaged to become dull, thus providing extremely bad workability because the sand, the soil and the gravel are caught and pass between the rotary-type cutting edge and the stationary-type cutting edge or remains before the cutting edges. Therefore, there has been provided no crushing apparatus which can suitably be used for disposal of mass scrap woods cut away from tree.

As such, then scrap woods such as branches, leaves, trunks and roots which are cut away during tree trimming operation in park, green zone, median strip and the like are mass. the scrap woods are carried on trucks and transferred to a dumping ground without crushing the scrap woods. The scrap wood are bulky and, as a result, their carrying efficiency is reduced. Since the scrap wood is green and cannot easily be combusted, it must be subjected to a special treatment prior to dumping on the ground. The cost for the treatment is calculated on the number of the trucks used. If the number is increased, the cost is increased. The bulky scrap woods are costly because they need many trucks.

SUMMARY OF THE INVENTION

For the purpose of dissolving the above-described problems, the invention is accomplished.

A object of the invention is to provide a high-speed crushing apparatus capable of crushing scrap woods such as flexible small branches, leaves and roots.

A further object of the invention is to provide a high-speed-crushing apparatus capable of efficiently crushing scrap woods even if they have various (namely small and big) sizes.

Another object of the invention is to provide a high-speed crushing apparatus capable of keeping its cutting edges sharp and making an extremely reduced noise.

According to the invention, there is provided a high-speed crushing apparatus comprising a hopper, two cutting edges one of which is stationary-type and the other rotary-type, the two cutting edges being disposed below the hopper, a crusher disposed downstream of the two cutting edges, the crusher including a shaft facing the rotary-type cutting edge and a plurality of cutters attached rotatably in the rotation axis direction of the shaft and slidably to the shaft, and a guide plate disposed between the rotary-type cutting edge and the cutters.

The high-speed crushing apparatus is characterized by combination of the rotary-type cutting edge, the cutter disposed downstream of the rotary-type cutting edge (which is rotating for slicing at high rate) and slidably in the direction of the rotation axis of the shaft, and the guide plate whereby it can successfully crush scrap woods of various kinds, even at high rate. Further, the apparatus can control the size of resulting fragments. Furthermore, any one can safely and easily remove and mount the cutters. As a result, the apparatus needs no mesh-screening part (which has heretofore been provided), thus providing extremely enhanced crushing efficiency and workability. The resulting fragments are not bulky, thus providing increased carrying capacity. That is to say, the number of trucks used for carrying to the ground can be decreased and, eventually, the cost therefor can be reduced.

Preferably, the shaft has a groove, and the cutters have, respectively, protrusions interposed in the groove and are connected with each other via a plurality of springs, the cutters being adapted to stand under the bias of the springs.

In that case, the apparatus may be provided with thin cutters even for a prolonged period of time. That is to say, the cutter does not suffer from side-pressure and, in stead, the spring absorbs the side-pressure when the cutter is pressed sideward. As a result, the cutter does not experience concentrated pressure which would otherwise damage the cutter. If the apparatus is provided with thin cutters, flexible branches and leaves can surely and efficiently be disposed. Disassembling and assembling the cutters are extremely easy because the cutters are attached slidably in the rotation axis of the shaft with the aid of the springs.

More preferably, the shaft is a spline shaft.

If the apparatus is provided with a spline shaft as the shaft, workers can disassemble and/or assembly easily without paying attention to the position of the groove. As a result, the disassembling and assembling operations can be done quickly. Further, as the cutters standarized ones may be employed.

Preferably, the guide plate extends from below the rotary-type cutting edge to the vicinity of the crusher and the end surface of the guide plate facing the circumference of the crusher is located at a slightly higher position than the central line of the rotation axis of the shaft.

If the guide plate is arranged so, after the scrap wood is crushed or sliced by the rotary-type cutting edge into fragments, the fragments are surely delivered and introduced before positions at which the cutters can surely crush, thus providing enhanced crushing efficiency. As a result, flexible small branches and leaves are surely crushed.

Preferably, the hopper has a charge port and a discharge port at a lower position thereof facing the stationary-type cutting edge, and has a plurality of guide sheets disposed longitudinally in standing position, each guide sheet extending inwardly from the lower surface of the inside.

If the hopper has the construction above, scrap woods are surely crushed by the rotary-type cutting edge because the guide sheets control the positions of the scrap woods. When the scrap woods are thin, they fall and are positioned between the space defined by the side walls of the neighboring guide sheets. When the scrap wood are thick, they are carried on the guide sheets or supported by the guide sheets. Foreign substances such as sand and soil attached to and gravel admixed in the scrap woods tend to be separated away and drop down. Thereafter, they are discharged outwardly from the discharge port. Therefore, the rotary-type cutting edge and the stationary-type cutting edge are not damaged and keep sharp. The scrap woods do not bound whereby the cutting operation is done stably and makes an extremely reduced noise.

BRIEF DESCRIPTION OF THE DRAWINGS

By way of example and to make the description more clear, reference is made to the accompanying drawings in which.

BRIEF DESCRIPTION OF THE PREFERRED EMBODIMENT

There is shown an embodiment falling within the scope of the invention with reference to FIGS. 1 to 5.

Figure 1:
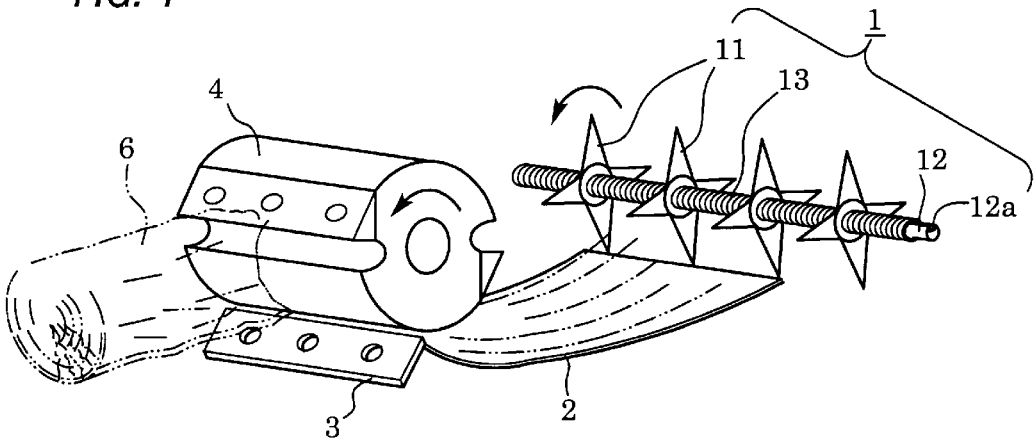
FIG. 1 is a perspective illustration of an embodiment high-speed crushing apparatus falling within the scope of the invention in operation.
Figure 2:
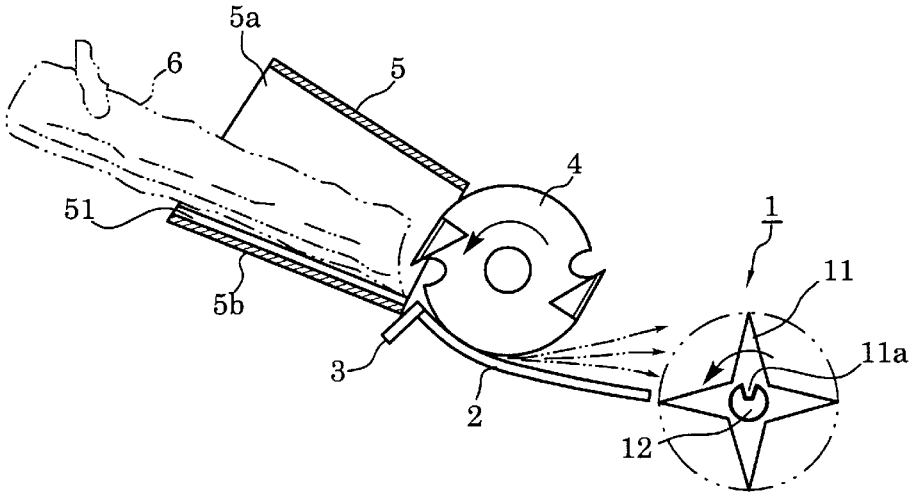
FIG. 2 is a cross-sectional view of the FIG. 1 apparatus, FIGS. 3(*a*), (*b*) is a view showing an arrangement of of cutters provided in the FIG. 1 apparatus.

Referring to FIGS. 1 and 2, numerical symbol 1 designates a crusher. The crusher 1 is disposed downstream of a rotary-type cutting edge 4. The rotary-type cutting edge 4 is disposed below a hopper 5. The crusher 1 comprises a plurality of cutters 11. The cutters 11 are attached to a shaft 12 and is adapted slidably in the rotation axis direction of the shaft 12. The shaft 12 is positioned so that the side circumference faces the rotary-type cutting edge 4. The cutters 11 have protrusions 11*a*, respectively. The shaft 12 has a groove 12*a*. The protrusions 11*a* are interposed in the groove 12*a*. When the protrusions 11*a* are interposed, the cutters 11 are in standing position. Between the cutters 11 is interposed a spring 13. The cutters 11 are connected with each other via a plurality of the springs 13. When the crusher 1 is ready for crushing, the springs 13 are being against the bias and the cutters 11 are slidable in the rotation axis direction. The shaft 12 may be a spline shaft. Under operation, the cutters 11 are fixed to the shaft 11 while they are driven or rotated by the shaft 12 and movable in the rotation axis direction of the shaft 12 to a certain extent. The cutters 11 can easily be exchanged, that is to say, easily be removed and mounted.

Numerical symbol 2 designates a guide plate. The guide plate 2 extends from below the rotary-type cutting edge 4 to the vicinity of the circumference of the crusher 1. Further, the end surface of the guide plate facing the circumference of the crusher is located at a slightly higher position than the central line of the rotation axis of the shaft. After the scrap wood 6 is sliced up with the rotary-type cutting edge 4, the sliced scrap wood 6 is delivered and introduced to a given position. That is to say, the guide plate 2 serves to guide the sliced scrap wood 6.

Numerical symbol 3 designates a stationary-type cutting edge. The stationary-type cutting edge 3 is also disposed below the hopper 5.

Figure 5:
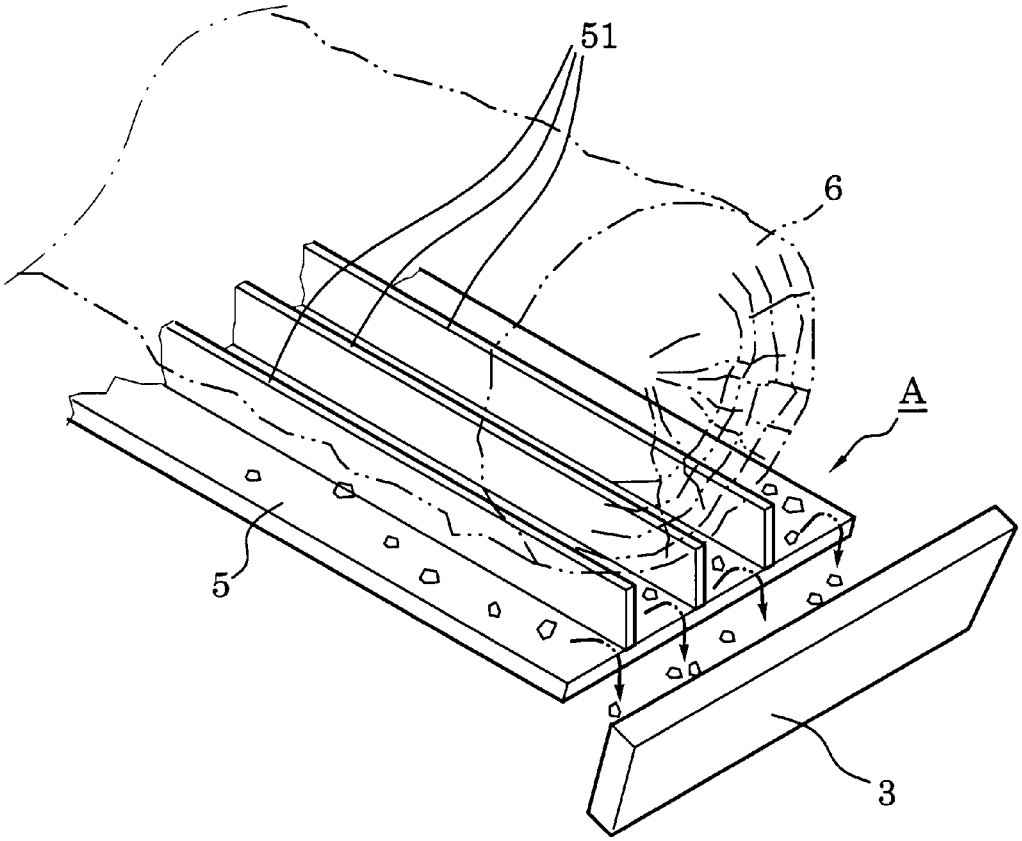
FIG. 5 is a perspective illustration of the inside of the hopper provided in the FIG. 1 apparatus.

The hopper 5 has a charge port 5*a* and a discharge port 5*b*. The discharge port 5*b* is positioned at a lower position of the hopper 5 and faces the stationary-type cutting edge 3. On the lower surface of the inside of the hopper 5 are disposed a plurality of guide sheets 51. FIG. 5 shows an arrangement of the guide sheets 51. The guide sheets 51 are standing position. That is to say, one narrower side surface of each guide sheet 51 is contacted with and fixed on the lower surface. The guide sheets 51 extend inwardly from the lower surface of the inside and from the vicinity of the charge port 5*a* before the stationary-type cutting edge 3. When the scrap wood 6 is flexible branches or leaves, the scrap wood 6 is interposed between the space defined by the side walls of the neighboring guide sheets 51, namely is prevented from moving, proceeds toward the rotary-type cutting edge 4 and is cut away. When the scrap wood 6 is thick branches or trunks, it is carried on the guide sheets 51 and delivered. In that case, the guide sheets 51 cut into the lower position of the scrap wood 6 thereon whereby the scrap wood 6 is fixed. Accordingly, the scrap wood 6 does not bound.

with respect to the guide sheets 51, there is taught in our prior Japanese Utility Model Laid Open Disclosure (kokai) No. 38516/97 (published Feb. 10, 1997) entitled "SEPARATER FOR A CRUSHING APPARATUS".

Below is described how the high-speed crushing apparatus of the invention works.

Thick branches or trunks as the scrap wood 6 are lifted up by a worker and incharged into the hopper 5 from the incharge port 5*a*. The scrap wood 5 drops in the hopper 5 down on the guide sheets 51. The end tip of the scrap wood 6 is hit against the rotary-type cutting edge 4 and is then sliced by the rotary-type cutting edge 4. The sliced scrap wood 6 is thrown downstream and crushed by the cutters 11, which are rotating at high rate. As a result, the scrap wood 6 is immediately crushed under the conditions that the rotary-type cutting edge 4 and the cutters 11 are together rotating (see FIG. 2).

Below is described how to the cutters 11 work.

The cutters 11, together with springs 13 disposed therebetween, are attached to the shaft 12 movably to a certain extend in the rotation axis direction of the shaft 12. Therefore, the cutters 11 does not suffer from side-pressure because when the cutters 11 are pressed sideward, they are inclined as the full line arrow indicates under the bias of the springs 13 and the springs 13 absorb the side-pressure. After the pressure has disappeared, the cutters 11 receive spring-back force as the chain line arrow indicates, and returns by the spring back effect, which are ready for successive crushing operation. Accordingly, the cutters 11 receives no concentrated stress and does not easily break. As a result, as the cutter 11 can successfully be used thin cutters or thin edges. That is to say, the cutters of the invention have a prolonged life compared with existing cutters of types secured by a bolt and a lock nut.

If the number of the cutters 11 mounted and the span between the neighboring cutters 11 are adjusted and the rotation rates of the rotary-type cutting edge 4 and the cutters 11 are adjusted, the apparatus of the invention can control the sizes of resultant fragments from the scrap wood 6. After the scrap wood 6 is crushed by the cutting edges 3 and 4 into fragments, the guide plate 2 delivers and introduces the so-treated fragments before the cutters 11 at a certain position. The position determines a cutting angle by the cutters 11. The fragments are subjected further to a crushing treatment by the cutters 11. The fragments from the apparatus are uniform. When the cutters 11 are thin, even if flexible small branches or leaves pass without being crushed by the rotary-type cutting edge 4, they are size-reduced by the cutters 11 to have uniform sizes.

The increase or decrease of the number of the cutters 11 and the exchange of the cutters 11 are done as follows. The springs 13 are attached to the shaft 12 using a washer and a nut (not shown). Firstly, the springs 13, together with the washer, are removed from the shaft 12 by loosening the nut. Secondly, the number of the cutters 11 is changed, or one or more of the cutters 11 are exchanged. The springs 13 are always disposed between the cutters 11 and serve to connect the cutters 11. Thereafter, the cutters 11 are attached to the shaft 12 by interposing their protrusions 11*a* into the groove 12*a* of the shaft 12 and are secured by the nut tighted against the washer. The cutters 11, upon being attached, are disposed slidably in the rotation axis direction of the shaft 12. The cutters 11 are connected with the springs 13. When the cutters 11 have been attached to the shaft 12, the cutters 11 are in standing position under the bias of the springs 13.

Figure 3A:
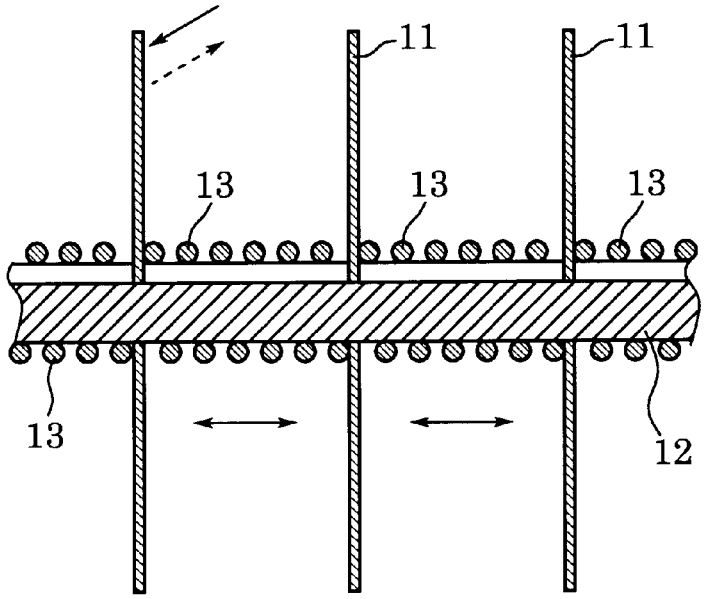
Figure 3B:
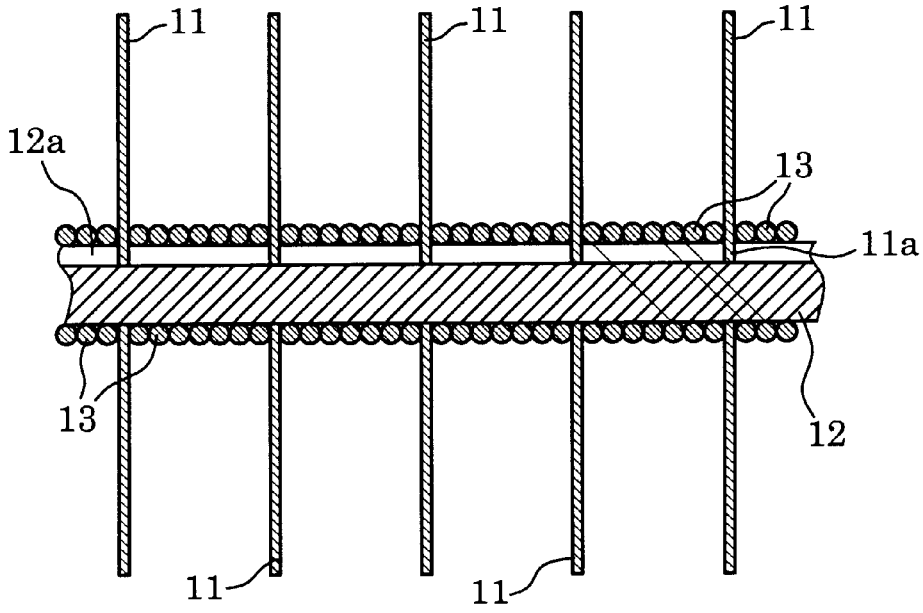
Figure 4:
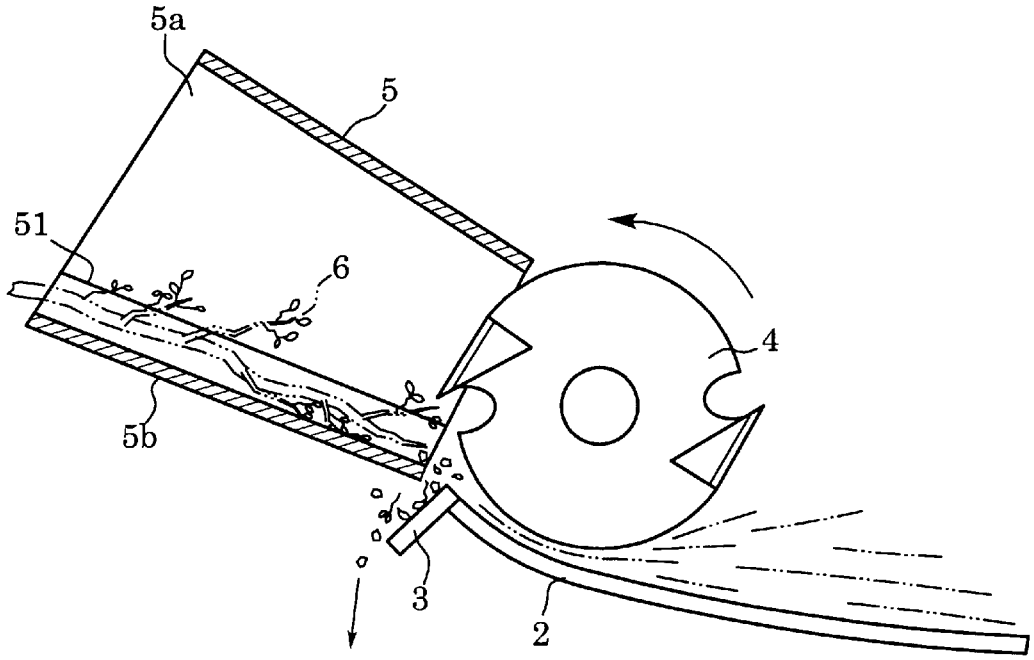
FIG. 4 is a partially enlarged, cross-sectional view of the FIG. 1 apparatus.

As described above, according to the apparatus of the invention, the cutters 11 can easily be exchanged. Furthermore, the pitch of the cutters 11 can be adjusted extending wide ranges, as shown in FIG. 3*a* and FIG. 3*b*.

Below is described how the guide sheet 51 works.

One case is where the scrap wood 6 is small or thin ones such as small branches, leaves and roots. When the scrap wood 6 is incharged into the hopper 5 by a worker from the incharge port 5*a*, the scrap wood 6 falls within the space defined by the side walls of the neighboring guide sheets 51 and drops down in the hopper 5 on the lower surface thereof while it is prevented from moving by the side walls, namely prevented from jumping or skipping (see FIG. 4). That is to say, the scrap wood 6 is surely delivered before the stationary-type cutting edge 3. The end tips of the scrap wood 6 hit against the stationary-type cutting edge 3 and the scrap wood 6 is cut by the rotary-type cutting edge 4 into fragments.

Another case is where the scrap wood 6 is thick. When the scrap wood 6 is lifted up and incharged into the hopper 5 by a worker from the incharge port 5*a*, the scrap wood 6 drops down in the hopper 5 while being placed or carried on the guide sheets 51 (see FIG. 2). That is to say, the scrap wood 6 does not fall into the space defined by the side-walls of the neighboring guide sheets 51. The upper surface of the guide sheet 51 (which has a narrow width) cuts into the scrap wood 6 by destroying the fiber of the scrap wood 6 thereby to stably fix the scrap wood 6 although the scrap wood 6, somewhat, is in floating position or bounds. The occurrence rate of bound is extremely reduced. Foreign substances such as sand and soil attached to and gravel admixed in the scrap woods hit against the side surface of the stationary-type cutting edge 3 and are discharged outwardly from the discharge port 5*b*. That is to say, the substances are prevented from being caught by the rotary-type cutting edge 4 and delivered forwardly. The rotary-type cutting edge 4 slices the scrap wood 6 on the guide sheets 51. Accordingly, the scrap wood 6 is sliced on a cutting position extremely higher than existing ones. As a result, the cutting positions of thin and thick scrap woods can be cut at different cutting angles. The guide sheets 51 make possible to cut various scrap woods such as big, small, thick and thin ones successfully. Upon being subjected to crushing treatment with the apparatus of the invention, the volume of the scrap wood 6 is reduced to one fifth.

What is claimed is:

1. A high-speed crushing apparatus, comprising:

a hopper into which a scrap wood is charged;

two cutting edges for slicing the scrap wood from the hopper into pieces, one of which is an upper rotary-type and the other a lower stationary-type;

the two cutting edges being so disposed downstream of the hopper along the path of the scrap wood that the scrap wood within the hopper is delivered to the two cutting edges;

a crusher including a shaft facing the rotary-type cutting edge and a plurality of cutters attached perpendicularly and slidably to the shaft under rotation of the shaft, the crusher disposed downstream of the two cutting edges along the path of the pieces, the shaft being adjusted rotatably in the same rotation direction as the rotary-type cutting edge; and a guide plate extending from below the rotary-type cutting edge and downstream of the stationary-type cutting edge to the crusher, the guide plate being disposed away from the rotary-type cutting edge by a space through which, when the rotary-type cutting is being rotated, the pieces can be passed to be thrown backward to the cutters of the crusher being rotated.

2. The high-speed crushing apparatus according to claim 1, in which the shaft has a groove extending in the rotation axis thereof, and the cutters have, respectively, protrusions interposed in the groove and are connected with each other via a plurality of springs, the cutters being adapted to stand under the bias of the springs.

3. The high-speed crushing apparatus according to claim 2, in which the shaft is a spline shaft.

4. The high-speed crushing apparatus according to claim 1, in which the guide plate extends from below the rotary-type cutting edge to the vicinity of the outermost circumference of the cutters, the downstream end part of the guide plate along the path of the pieces being disposed at a position slightly higher than the center of the shaft to which the cutters are attached.

5. The high-speed crushing apparatus according to claim 1, in which the hopper has a charge port and a discharge port at a lower position thereof facing the stationary-type cutting edge, and has a plurality of guide sheets disposed longitudinally in standing position, each guide sheet extending inwardly from the lower surface of the inside.

* * * * *